US007210322B2

(12) United States Patent
Iwata

(10) Patent No.: US 7,210,322 B2
(45) Date of Patent: May 1, 2007

(54) DENT DISTRIBUTION DIAGRAM DRAWING METHOD AND SYSTEM IN SHOTBLASTING, AND PROCESSING CONDITIONS SETTING METHOD AND SHOTBLASTING DEVICE

(75) Inventor: Kyoichi Iwata, Toyokawa (JP)

(73) Assignee: Sintokogio, Ltd., Aichi-Ken (JP)

( * ) Notice: Subject to any disclaimer, the term of this patent is extended or adjusted under 35 U.S.C. 154(b) by 126 days.

(21) Appl. No.: 10/525,741

(22) PCT Filed: Aug. 28, 2003

(86) PCT No.: PCT/JP03/10918

§ 371 (c)(1),
(2), (4) Date: Feb. 28, 2005

(87) PCT Pub. No.: WO2004/020149

PCT Pub. Date: Mar. 11, 2004

(65) Prior Publication Data

US 2005/0250420 A1 Nov. 10, 2005

(30) Foreign Application Priority Data

Aug. 28, 2002 (JP) ..... 2002-248015
Jul. 30, 2003 (JP) ..... 2003-282237

(51) Int. Cl.
*G06F 19/00* (2006.01)

(52) U.S. Cl. ..... 72/53; 700/117; 700/143; 700/145

(58) Field of Classification Search ..... 700/117, 700/143, 145; 72/53
See application file for complete search history.

(56) References Cited

U.S. PATENT DOCUMENTS 5,581,483 A * 12/1996 Thompson et al. ..... 702/179
6,415,044 B1 * 7/2002 Simpson et al. ..... 382/108

FOREIGN PATENT DOCUMENTS

JP 2002-059366 A 2/2002
JP 2002-160161 A 6/2002
JP 2003-159651 A 6/2003

* cited by examiner

*Primary Examiner*—Michael D. Masinick
(74) *Attorney, Agent, or Firm*—Finnegan, Henderson, Farabow, Garrett & Dunner, L.L.P.

(57) ABSTRACT

A method and a device for easily setting a processing condition from a dent rate of a product by giving an arbitrary dent producing condition and a shotblast processing condition in a shotblasting process. The method calculates a processing time, a projection amount and a projection material speed for enabling a target dent rate to be set, from the number of dents in a predetermined dent unit area and time. The method comprises the steps of: calculating a dent unit area from a projection material hardness, a projection material particle size, a projection material speed and the hardness of a processed product; calculating the number of dents required to attain a predetermined target dent rate; and calculating a processing time from the number of dents, a projection amount, a projection material density and the projection material particle size.

6 Claims, 9 Drawing Sheets

Processing time :2sec
Dent rate : 54.8%

Processing time :3sec
Dent rate : 69.6%

Processing time :4sec
Dent rate : 79.6%

Processing time :5sec
Dent rate : 86.3%

Processing time :6sec
Dent rate : 90.8%

Processing time :9sec
Dent rate : 97.2%

DENT DISTRIBUTION DIAGRAM DRAWING METHOD AND SYSTEM IN SHOTBLASTING, AND PROCESSING CONDITIONS SETTING METHOD AND SHOTBLASTING DEVICE

FIELD OF THE INVENTION

This invention relates to a method and a system for drawing a dent distribution diagram in shotblasting, and more particularly, to a method and a system suitable to simulating drawing a dent distribution diagram by a computer in shotblasting.

BACKGROUND OF THE INVENTION

In shotblasting, it is important to uniformly distribute the projected grainy material on the surface of a product. Therefore, to indicate a degree of uniform distribution in shotblasting, a dent rate (coverage) is used, which is a ratio to an evaluation area of a shot blasted surface of a product, which area is a part of the shot blasted surface and is an area arbitrarily predetermined for evaluation, of the total area of dents created in the area. Moreover, in many cases the work to set, or determine, the shotblast processing condition to achieve a target coverage for a product when it is shot blasted temporarily sets a shotblast processing condition based on current experiences; carries out shotblasting under the condition; examines the shot blasted surface of the product to see dents in the surface; and measures the coverage, to narrow the condition.

By the way, conventionally there are two mainstream methods for measuring the dent rate, namely, a standard measuring method and a summary measuring method. The standard measuring method is to enlarge an arbitrary evaluation area of a shot blasted product by a microscope; take a photograph of the area in a 20–50 times enlarged scale; cut away the dented parts or untreated parts from the area; and obtain the dent rate from the percentage thereof by weight. The summary measuring method is to observe a shot blasted surface of the product by an observation apparatus such as a loupe with a 20–50 times magnifying power or a stereoscopic microscope; and compares the observed surface with reference photographs for comparison, to judge its rough dent rate value. And, the summary measuring method is mainly used for the reasons for the measurement frequency, the man-hours, etc.

However, though in the summary measuring method the reference photographs are made for their dent rates by using the standard measurement method, it is difficult in some products to judge if a part of them is dented or untreated. Further, in the standard measurement method itself there is a possibility to cause a dispersion due to the individual variations, and the dent rate must be measured by actually carrying out shotblasting for products to determine the shotblast processing condition. Moreover, because the area, the size, and the depth per dent change due to the shotblast processing condition, the hardness and the particle size of the projection material, the difference of the hardness between the product and the projection material, etc., it is necessary to make many reference photographs for each product. Additionally, the dent rate for a processed surface in a shotblasting processing that aims to decrease wear-out by fluid lubrication may be extremely low, and hence the range of the dent rates by the reference photographs must be increased.

This invention has been conceived in view of those circumstances. The main purpose of the invention is to provide a method and a system for simulating drawing a dent rate and a dent distribution diagram of a product by a computer, by giving an arbitrary dent producing condition and a shotblast processing condition in shotblasting.

A further purpose of the invention is to provide a method for setting a processing condition in shotblasting to obtain an arbitrary dent producing condition, a shotblast processing condition, and a target dent rate for a product in shotblasting and to provide a shotblasting device that uses the setting method.

SUMMARY OF INVENTION

To the above ends, a method 1 for drawing a dent distribution diagram in shotblasting is a method for simulating by a computer drawing a dent distribution diagram of a surface processed by a shotblasting process, comprising: a first inputting step for inputting a dent unit area, the number of dents, and an evaluation area to the computer; a first computing step for computing a dent rate from a theoretical formula $C=100\{1-\exp(-A\cdot N/As)\}$, based on the dent unit area, said number of dents, and the evaluation area inputted to the computer, where C is a dent rate (coverage) (%), A is a dent unit area ($mm^2$), N is the number of dents (piece·$mm^2$·sec), and As is an evaluation areas ($mm^2$); a first calculating step for calculating, based on the dent unit area, said number of dents, and the evaluation area input to the computer, a drawing dent unit area, the number of dents to be drawn, and a drawing evaluation area, which are necessary to draw a dent distribution status by a drawing device; a second calculating step for performing calculations necessary to display in the drawing evaluation area a dent pattern of said number of dents to be drawn, each of the dents having the drawing dent unit area; and a step for displaying or printing by the drawing device the dent rate and the results of the calculations performed by the second calculating step.

A method 2 for drawing a dent distribution diagram in shotblasting is a method for simulating by a computer drawing a dent distribution diagram of a surface processed by a shotblasting process, comprising: a dent rate inputting step for inputting a dent rate to the computer; a dent existence ratio computing step for computing a dent existence ratio K from a theoretical formula $C=100\{1-\exp(-A\cdot N/As)\}$, based on the inputted dent rate, where C is a dent rate (coverage) (%), A is a dent unit area ($mm^2$), N is the number of dents (piece·$mm^2$·sec), As is an evaluation area ($mm^2$), and K is a dent existence ratio ($A\cdot N/As$); a second inputting step for inputting at least two of a drawing dent unit area, the number of dents to be drawn, and a drawing evaluating area to the computer; a third calculating step for calculating, based on the computed dent existence ratio and the inputted at least two of the drawing dent unit area, said number of dents to be drawn, and the drawing evaluation area, a drawing dent unit area, the number of dents to be drawn, and a drawing evaluation area, that are necessary to draw a dent distribution status by a drawing device; a fourth calculating step for performing calculations necessary to display in the drawing evaluation area a dent pattern of said number of dents to be drawn, each of the dents having the drawing dent unit area; and a step for displaying or printing by the drawing device the dent rate and the results of the calculations performed by the second calculating step.

A method 3 for drawing a dent distribution diagram in shotblasting is a method for simulating by a computer drawing a dent distribution diagram of a surface processed by a shotblasting process, comprising: a third inputting step for inputting a shotblast processing condition to the computer; a dent unit area computing step for computing a dent unit area from empirical formulas $A=\pi D^2/4$ and $D=k1\cdot d\cdot\{1-\exp(k2\cdot HVa/HVw)\}/\{1-\exp(k3\cdot V)\}$, based on the inputted shotblast processing condition, where k1, k2, and k3 are coefficients (having dimensions), A is a dent unit area ($mm^2$), D is the diameter (mm) of a dent, HVa is the hardness (HV) of the projection material, d is the size (mm) of the particles of the projection material, v is a projection speed (m/sec), and HVw is the hardness (HV) of a product to be processed; a dent number computing step for computing the number of dents from an empirical formula $N=k4\cdot M/(\rho\cdot d^3/6\cdot\pi)\cdot(t/60)$ As, based on the inputted shotblast processing condition, where k4 is a coefficient (having dimensions), N is the number of dents (piece·$mm^2$·sec), M is a projection amount (kg/min) of the projection material, t is a processing time (sec), F is the density ($g/cm^3$) of the projection material, As is an evaluation area ($mm^2$); a second dent rate computing step for computing a dent rate from a theoretical formula $C=100\{1-\exp(-A\cdot N/As)\}$, based on the computed dent unit area, said number of dents, and an evaluation area arbitrarily set, where C is a dent rate (%) (coverage), A is a dent unit area ($mm^2$), N is the number of dents (piece·$mm^2$·sec), As is an evaluation area ($mm^2$); a fifth calculating step for calculating a drawing dent unit area, the number of dents to be drawn, a drawing evaluating area, that are necessary to display a dent distribution status by a drawing device, based on the computed dent unit area and said number of dents, and the evaluation area arbitrarily set; a sixth calculating step for performing calculations necessary to display in the drawing evaluation area a dent pattern of said number of dents to be drawn, each of the dents having the drawing dent unit area; and a step for displaying or printing by the drawing device the dent rate and the results of the calculations performed by the sixth step.

To achieve the purposes of the invention, there is also provided a method for setting a processing condition in a shotblasting process characterized in that a processing time is computed to attain a target dent rate from the number of dents per given dent unit area during a given period of time.

To achieve the purposes of the invention, there is also provided a method for setting a processing condition in a shotblasting process that comprises the steps of: computing a dent unit area from a given hardness of a projection material, a given projection particle size of a projection material, a given speed of the projection material, and a given hardness of a product to be processed; computing the number of dents necessary to attain a given target dent rate; and computing a processing time from the number of dents, a projection amount, a density of the projection material, and the projection particle size of the projection material.

DETAILED DESCRIPTION OF THE PREFERRED EMBODIMENTS

In this invention a shotblasting process includes removing foreign material from a surface of a product of metal, nonmetal, plastic, etc. by projecting or jetting, by an accelerator of a centrifugal type, a fluid pressure type, or the like, particles of steel, ceramic, etc., as grainy projection material, at a high speed to collide them against that surface. The shotblasting process can include a shot peening, which is carried out by colliding projection material against a surface of a product for enhancing the fatigue strength of the surface, and a process for jetting painting material or medicine instead of the shotblasting or shot peening projection material by a painting device or a medicine nebulizer.

Moreover, in this invention a dent may be a depression generated in a product in a shotblasting process when projection material collides it, which depression is very shallow, and the depth of it is negligible. By changing the coefficients used in the step of computing a dent unit area, the dent may be a range (or area) that is affected to receive a residual stress due to the stress induced transformation in a shot peening process, or may be projected paint or medicine that has adhered to a product.

Moreover, in this invention a dent unit area is an area for one dent. Moreover, in this invention a dent distribution status is an appearance of the dents in a surface of a product subjected to a shotblasting process. Moreover, in this invention an evaluation area is an area for which a dent distribution status is observed. Moreover, in this invention the number of dents is the number of dents generated in the evaluation area for a period of an arbitrary processing time during a shotblasting process. Moreover, in this invention, a shotblast processing condition is one to determine the number of dents and the dent unit area, such as a condition of the hardness, particle size, and projection amount of the projection material, the hardness of a product to be processed, a processing time for it, etc.

Moreover, in this invention the dent rate is computed by the following two methods. The first one is to input the dent unit area, the number of dents, and the evaluation area to a computer and to compute the dent rate from a theoretical formula $C=100\{1-\exp(-A\cdot N/As)\}$. However, in this invention, ex is replaced with the function of x, namely, exp(x) for the convenience of the mark.

By the way, the theoretical formula, $C=100\{1-\exp(-A\cdot N/As)\}$, is derived as follows, where C is a dent rate (%)

Figure 1:
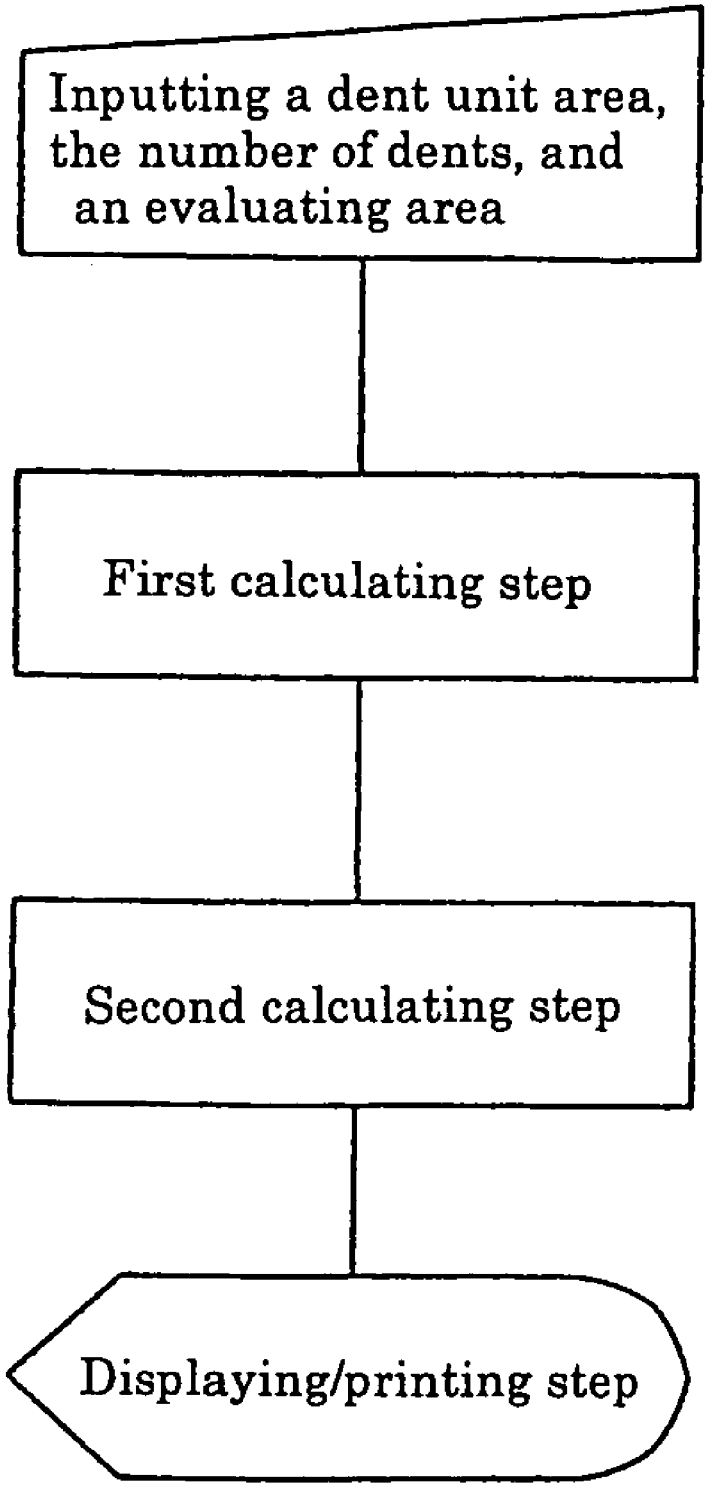
FIG. 1 is a flowchart corresponding to method 1.
Figure 2:
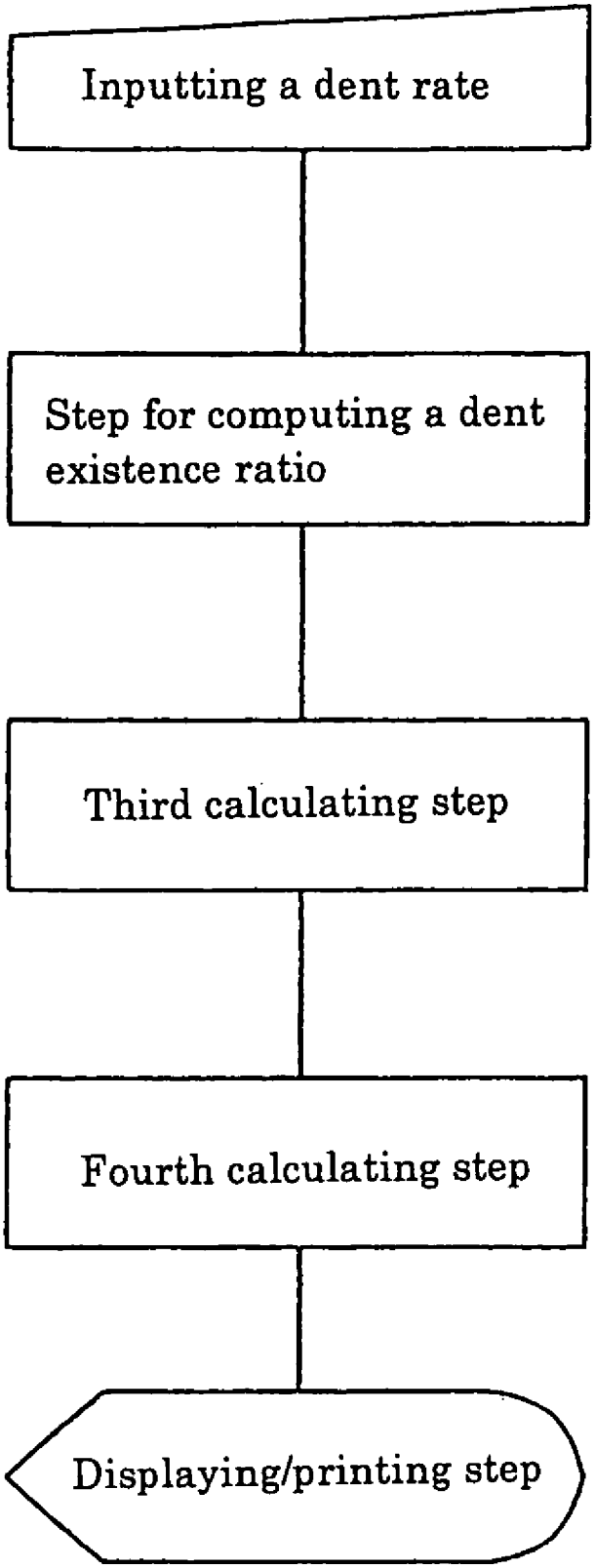
FIG. 2 is a flowchart corresponding to method 2.
Figure 3:
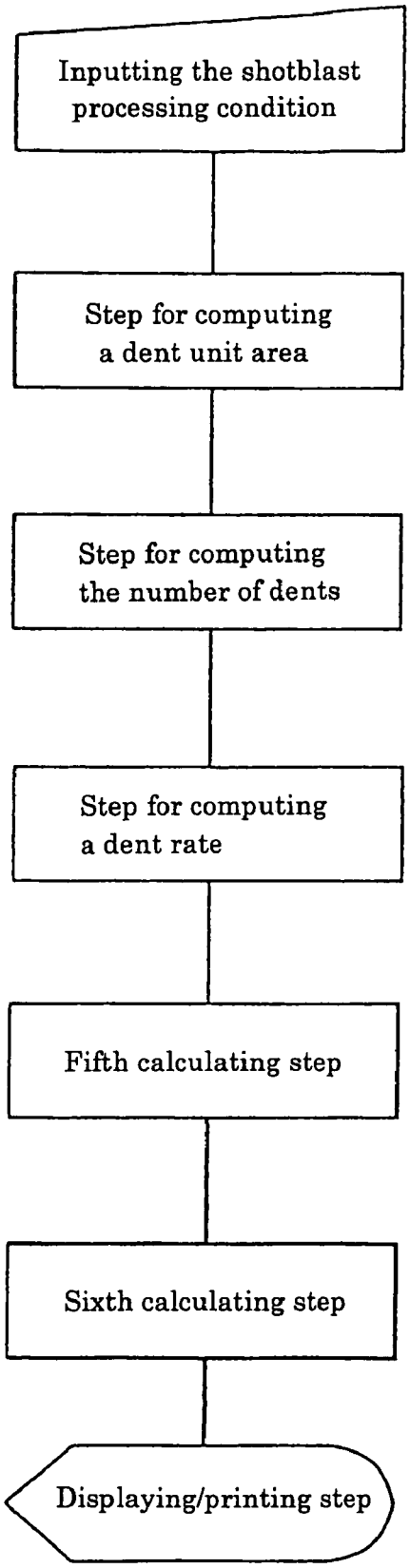
FIG. 3 is a flowchart corresponding to method 3.
Figure 4:
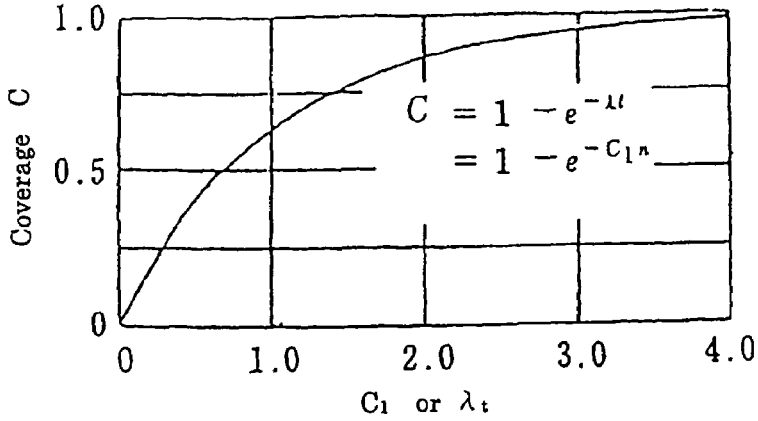
FIG. 4 is a graph showing a relationship between the number n and a dent rate, where n is the times a product passes through a place where projection material is projected.

(coverage), A is a dent unit area ($mm^2$), N is the number of dents (piece·$mm^2$·sec), and As is an evaluation areas ($mm^2$). That is, when a product passes through a shotblasting zone n times, where a projection material is projected, and when an actual dent rate of the product is measured, when assuming the measurement value C1, the dent rate Cn can be presumed to be 1−(1−C1)n (see page 121 of "Method and Effect of Shotblasting," published by the Nikkan Kogyo Newspaper Co.). One example calculated by this expression is shown in FIG. 4.

The expression Cn=1−(1−C1)n, with the dent rate being asymptotic in 100% over the processing time, can be generally expressed as the following expression: C=100{1−exp(−t/a)}. When the expression is differentiated by time t and t=0 is substituted, then C'(t=0)=(100/a) exp(−0/a)=100/a. The linear expression of time t that has this slope is expressed as Cv(%)=C'·t=(100/a)·t. This linear expression Cv(%)=C'·t=(100/a)·t is the virtual dent rate Cv when it is assumed that there is no mutual overlapping of the dents.

Moreover, when the gross area of the dents is assumed to be a total dent area Aa, and when Cv becomes 100%, Cv (%)=Aa/As=100%, and from this Aa=As. That is, the total dent area Aa and the evaluation area As become equal. The time t at that time becomes Cv(%)=(100/a)·t=100. Therefore, t=a. By the way, because the total dent area Aa is in proportion to time, Aa(t)=k·t. Moreover, since Aa(t)=k·t, Aa(t=a)=k·a=As, therefore k=As/a. Therefore, Aa(t)=(As/a)·t. Further, since the total dent area Aa can be expressed by the number of dents N, the relation between the number of dents N and time is obtained as Aa=A·N=(As/a)t, and therefore, N=(As/A) (t/a). Therefore, (t/a)=(A·N)/As, and thus the theoretical formula of C=100{1−exp(−t/a)} is derived.

The second method of calculating the dent rate is shown below.

That is, the shotblast processing condition is inputted to the computer. The dent unit area is computed from empirical formulas $A=\pi D^2/4$ and D=k1·d·{1−exp(k2·HVa/HVw)}/{1−exp(k3·V)} based on the inputted shotblast processing condition, where k1, k2, and k3 are coefficients (having dimensions), A is a dent unit area ($mm^2$), D is a diameter (mm) of the dents, Hva is a hardness (HV) of the product to be processed, d is a projection material particle size (mm), v is a projection speed (m/sec), and HVw is a hardness (HV) of the projection material. Next, the number of dents is computed from an empirical formula $N=k4\cdot M/(\rho\cdot d^3/6\cdot\pi)\cdot(t/60)\cdot As$ based on the shotblast processing condition inputted to the computer, where k4 is a coefficient (having dimensions), N is the number of dents (piece·$mm^2$·sec), M is a projection amount (kg/min), t is a processing time (sec), F is a density (g/cm3) of the projection material, and As is an evaluation areas ($mm^2$). Next, the dent rate is computed from the theoretical expression, C=100{1−exp(−A·N/As)}, based on the computed dent unit area and the computed number of dents, and an evaluation area arbitrarily set, where C is a dent rate (%) (coverage), A is a dent unit area ($mm^2$), N is the number of dents (piece·mm2·sec), and As is an evaluation areas ($mm^2$).

Moreover, in this invention a drawing dent unit area, the number of dents to be drawn, and a drawing evaluation area are calculated, which are necessary to display a dent distribution status by a drawing device based on the inputted dent unit area, number of dents, and evaluation area. In these calculations, the correction for each numerical value is carried out in the beginning. There is a relation of A·N/As=AD·ND/AsD=constancy from the above-mentioned expression when the dent rates are equal. The values can be arbitrarily corrected to fulfill this expression. This is to display an evaluation area that has a uniform dent rate in an enlarged scale, and the dent rate is not changed in the enlarged scale.

Moreover, in this invention the calculations are performed for displaying in the drawing evaluation area a dent pattern of the number of dents to be drawn, each of the dents having the drawing dent unit area. In this case, the corrected value is drawn as an image that has an area As in a drawing area AsD of a drawing device such as a display and a plotter at a position determined by random numbers, and this is repeated N times, thereby drawing a dent distribution status and displaying the dent rate. Here, the drawing area AsD may be determined as a size suitable to observe the simulated drawing in coordination with the size of the screen or drawing sheet of the drawing device. For more accuracy of drawing, the ratio R of the drawing area AsD to the drawing dent unit area AD (i.e., R=AsD/AD) is preferably more than 100. Below, the result of doing this verification is explained.

When a predetermined number of dents are drawn in an evaluation area, there will be caused a dispersion of overlapping of dents if the drawing dent unit area AD is not very small relative to the drawing area AsD, causing an error between a simulatingly drawn dent rate and the target dent.

Then, the following verification was carried out.

Figure 5:
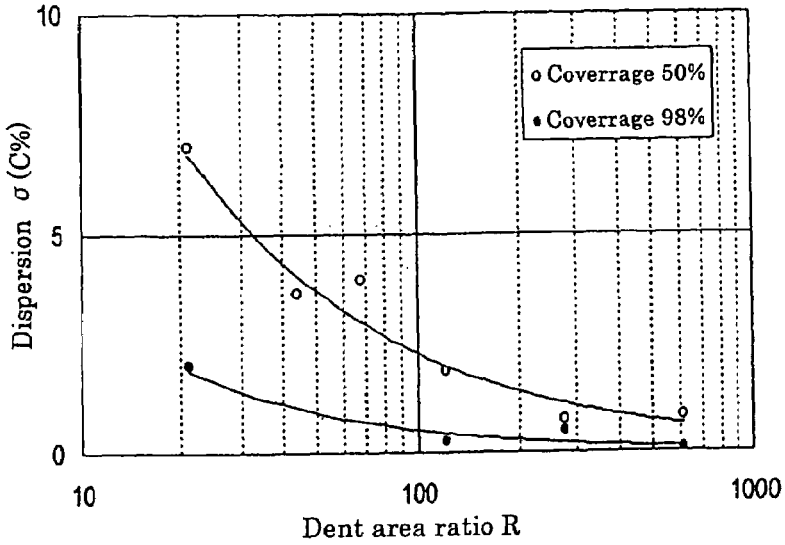
FIG. 5 is a graph showing dispersion of the dent rates to the dent area ratio R and is a diagram of the result of verifying dent area ratio R to decrease the dispersion of the dent rates.

As a verification condition, the dent area ratio, R=AsD/AD, is set to 20–600, and the dent rates are set to 50%, where the variation in the dent rate is great relative to that in the number of dents, and to 98%, where the variation in the dent rate is less relative to that in the number of dents. The simulated drawing for each for a dent distribution status is carried out ten times (n=10); the dent rate is then measured by using image processing software based on the area of the drawn dents; and its difference with the set value for the dent rate is obtained. The standard deviation σ is calculated from the difference and it is assumed to be a dispersion. FIG. 5 shows the result. FIG. 5 shows that σ<1% for both coverages, 50% and 98%, in the range of R>300, and that the accuracy is high. However, since the number of dents to be drawn increases, the dent rate setting of 98% can be used without trouble in case the range of R>100, where σ<1% (less than 1%). The dent area ratio R may be changed according to the dent rate demanded to be displayed and the demanded accuracy.

EXAMPLE 1

Figure 6:
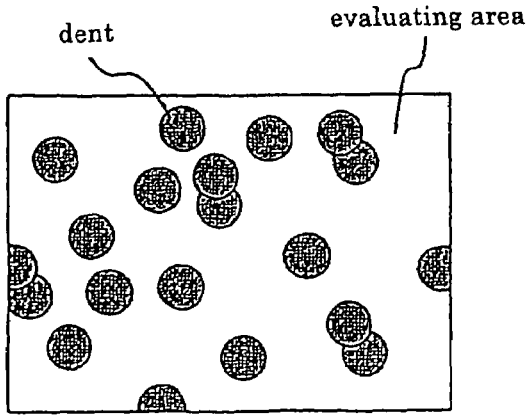
FIG. 6 is a diagram showing one example of the dent distribution diagram and the dent rate drawn in simulation by the drawing device in example 1.

The dent unit area, A=0.24 $mm^2$, the number of dents, N=500 piece·$mm^2$·sec, and the evaluation area, As=100 $mm^2$, were inputted to the computer and the dent rate C was calculated from the theoretical formula C=100{1−exp(−A·N/As)}. The calculated dent rate was 70%. Moreover, a drawing dent unit area, the number of dents to be drawn, and a drawing evaluation area, which are necessary to display a dent distribution status by a drawing device, were calculated based on the inputted dent unit area, number of dents, and evaluation area. The drawing dent unit area was 8 $mm^2$, the number of dents to be drawn was 500 pieces, and the drawing evaluation area was 3326.4 $mm^2$. And, the dent existence ratio was 413.6 for this case. These results are displayed by the drawing device as in FIG. 6.

EXAMPLE 2

The particle size 0.6 mm, density 7.85 g/$cm^3$, hardness HV700, projection amount 8 kg/min, and speed 60 m/s of the projection material, the hardness 400HV of a product to be processed, and processing times of 2, 3, 4, 5, 6, and 9 seconds were entered to the computer as the shotblast processing condition. A dent area ratio R is set as 120 (R=120), and coefficients of k1, k2, k3, and k4 were set as 0.75, −0.5, −0.02, and 100, respectively. These set values were inputted to the computer.

Figure 7:
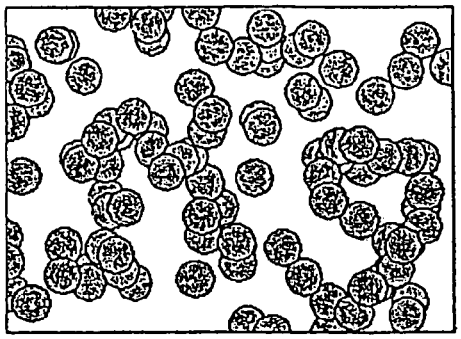
FIG. 7 is a diagram showing one example of the dent distribution diagram and the dent rate drawn in simulation by the drawing device in example 2.
Figure 7:
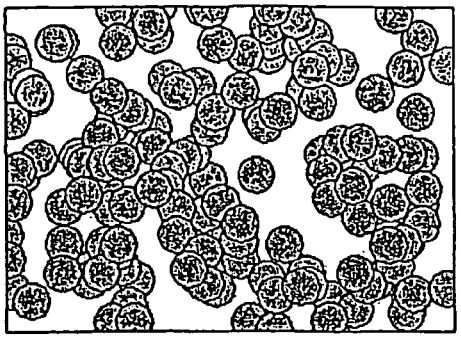
Figure 7:
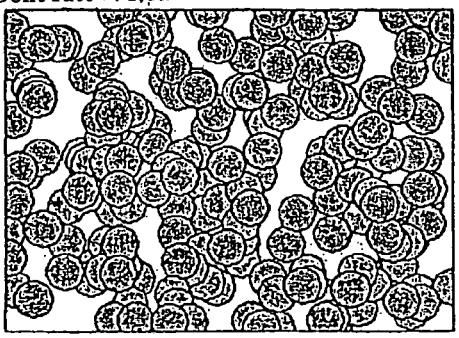
Figure 7:
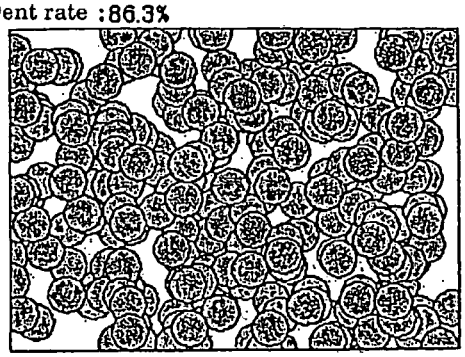
Figure 7:
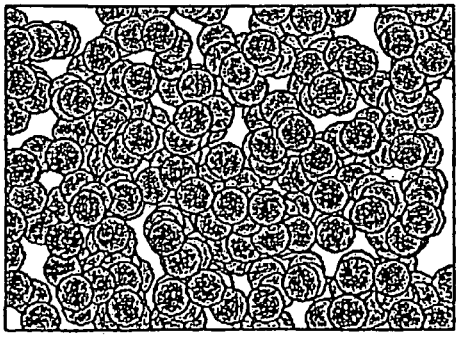
Figure 7:
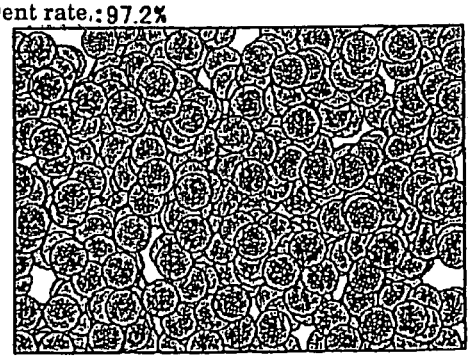
Figure 8:
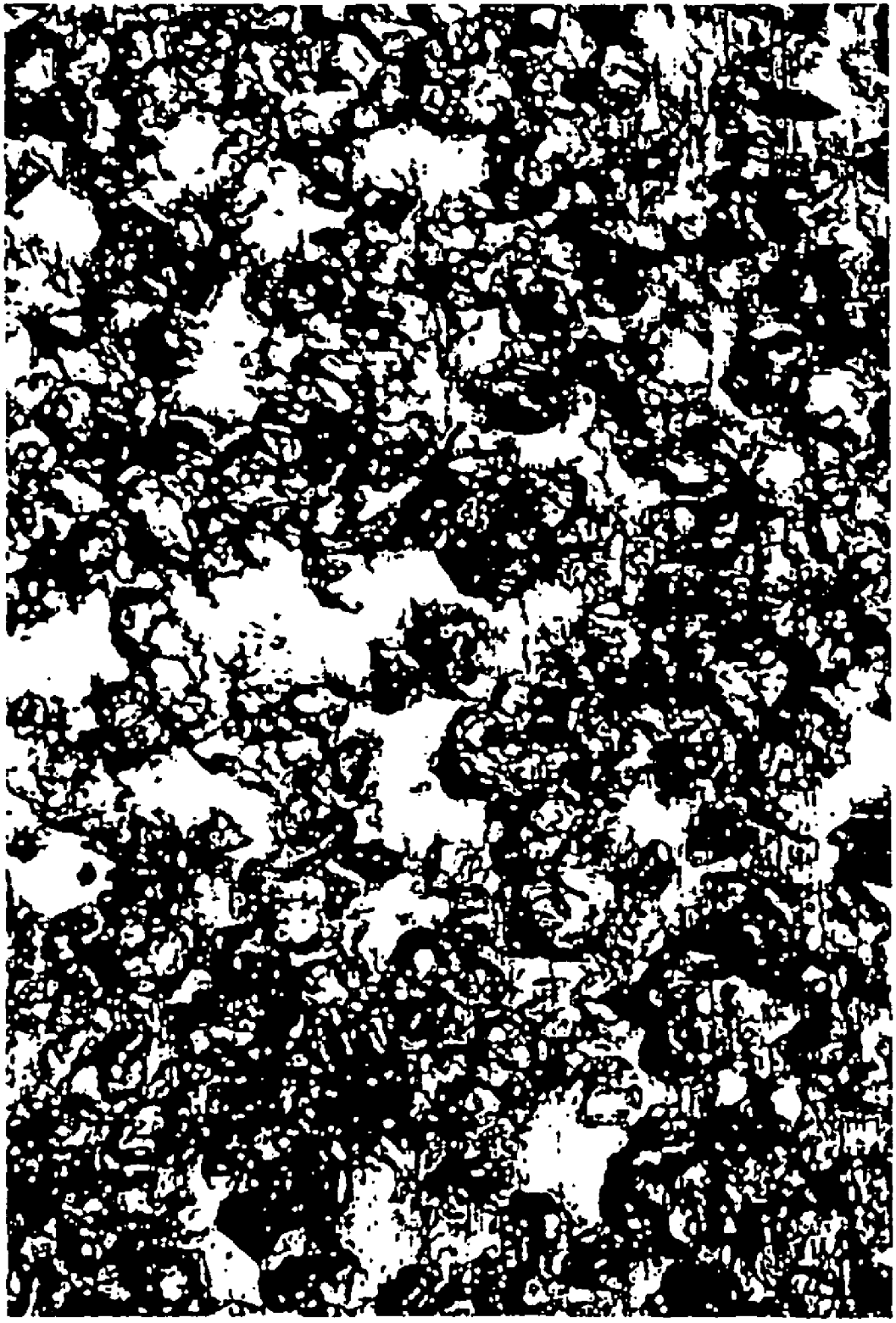
FIG. 8 is a photograph showing a dent distribution in an actual shotblasting process carried out as an example of comparing the present invention.

The computer then calculates a dent unit area from the empirical formulas $A=\pi D^2/4$ and $D=k1\cdot d\cdot\{1-\exp(k2\cdot HVa/HVw)\}/\{1-\exp(k3\cdot V)\}$ and calculates the number of dents from the empirical formula $N=k4\cdot M/(\rho\cdot d^3/6\cdot\pi)\cdot(t/60)\cdot As$. Next, it calculates a dent rate from the theoretical expression $C=100\{1-\exp(-A\cdot N/As)\}$ based on the calculated dent unit area and number of dents, and the evaluation area arbitrarily set, and then calculates a drawing dent unit area, the number of dents to be drawn, and a drawing evaluation area, which are necessary to display a dent distribution status by the drawing device, based on the calculated dent unit area and number of dents, and the evaluation area arbitrarily set. Next, the computer performs calculations necessary to display in the drawing evaluation area a dent pattern of the number of dents to be drawn, each of the dents having the drawing dent unit area. This calculation result and the dent rate are displayed or printed by the drawing device. Accordingly, a simulated drawing is obtained as in FIG. 7. FIG. 8 shows a result of an actual shotblasting process where the processing time of the shotblast processing condition is set as 3 second.

It is clear from the forgoing explanation that the method 1 for drawing a dent distribution diagram in shotblasting may be a method for simulating by a computer drawing a dent distribution diagram of a surface processed by a shotblasting process, comprising: a first inputting step for inputting a dent unit area, the number of dents, and an evaluation area to the computer; a first computing step for computing a dent rate from a theoretical formula $C=100\{1-\exp(-A\cdot N/As)\}$, based on the dent unit area, said number of dents, and the evaluation area inputted to the computer, where C is a dent rate (coverage) (%), A is a dent unit area ($mm^2$), N is the number of dents (piece·$mm^2$·sec), and As is an evaluation area ($mm^2$); a first calculating step for calculating, based on the dent unit area, said number of dents, and the evaluation area input to the computer, a drawing dent unit area, the number of dents to be drawn, and a drawing evaluation area, which are necessary to draw a dent distribution status by a drawing device; a second calculating step for performing calculations necessary to display in the drawing evaluation area a dent pattern of said number of dents to be drawn, each of the dents having the drawing dent unit area; and a step for displaying or printing by the drawing device the dent rate and the results of the calculations performed by the second calculating step, and that the method 2 for drawing a dent distribution diagram in shotblasting may be a method for simulating by a computer drawing a dent distribution diagram of a surface processed by a shotblasting process, comprising: a dent rate inputting step for inputting a dent rate to the computer; a dent existence ratio computing step for computing a dent existence ratio K from a theoretical formula $C=100\{1-\exp(-A\cdot N/As)\}$, based on the inputted dent rate, where C is a dent rate (coverage) (%), A is a dent unit area ($mm^2$), N is the number of dents (piece·$mm^2$·sec), As is an evaluation area ($mm^2$), and K is a dent existence ratio ($A\cdot N/As$); a second inputting step for inputting at least two of a drawing dent unit area, the number of dents to be drawn, and a drawing evaluating area to the computer; a third calculating step for calculating, based on the computed dent existence ratio and the inputted at least two of the drawing dent unit area, said number of dents to be drawn, and the drawing evaluation area, a drawing dent unit area, the number of dents to be drawn, and a drawing evaluation area, that are necessary to draw a dent distribution status by a drawing device; a fourth calculating step for performing calculations necessary to display in the drawing evaluation area a dent pattern of said number of dents to be drawn, each of the dents having the drawing dent unit area; and a step for displaying or printing by the drawing device the dent rate and the results of the calculations performed by the second calculating step. Thus, supplying an arbitrary dent producing condition enables a computer to simulate drawing the dent rate of a product and the dent distribution diagram. This enables us to see the status of the finishing of the product on a desk without carrying out any actual shotblasting process.

Moreover, the method 3 for drawing a dent distribution diagram in shotblasting may be a method for simulating by a computer drawing a dent distribution diagram of a surface processed by a shotblasting process, comprising: a third inputting step for inputting a shotblast processing condition to the computer; a dent unit area computing step for computing a dent unit area from empirical formulas $A=\pi D^2/4$ and $D=k1\cdot d\cdot\{1-\exp(k2\cdot HVa/HVw)\}/\{1-\exp(k3\cdot V)\}$, based on the inputted shotblast processing condition, where k1, k2, and k3 are coefficients (having dimensions), A is a dent unit area ($mm^2$), D is the diameter (mm) of a dent, HVa is the hardness (HV) of the projection material, d is the size (mm) of the particles of the projection material, v is a projection speed (m/sec), and HVw is the hardness (HV) of a product to be processed; a dent number computing step for computing the number of dents from an empirical formula $N=k4\cdot M/(\rho\cdot d^3/6\cdot\pi)\cdot(t/60)\cdot As$, based on the inputted shotblast processing condition, where k4 is a coefficient (having dimensions), N is the number of dents (piece·$mm^2$·sec), M is a projection amount (kg/min) of the projection material, t is a processing time (sec), F is the density ($g/cm^3$) of the projection material, As is an evaluation area ($mm^2$); a second dent rate computing step for computing a dent rate from a theoretical formula $C=100\{1-\exp(-A\cdot N/As)\}$, based on the computed dent unit area, said number of dents, and an evaluation area arbitrarily set, where C is a dent rate (%) (coverage), A is a dent unit area ($mm^2$), N is the number of dents (piece·$mm^2$·sec), As is the evaluation area ($mm^2$); a fifth calculating step for calculating a drawing dent unit area, the number of dents to be drawn, a drawing evaluating area, that are necessary to display a dent distribution status by a drawing device, based on the computed dent unit area and said number of dents, and the evaluation area arbitrarily set; a sixth calculating step for performing calculations necessary to display in the drawing evaluation area a dent pattern of said number of dents to be drawn, each of the dents having the drawing dent unit area; and a step for displaying or printing by the drawing device the dent rate and the results of the calculations performed by the sixth step. Accordingly, supplying an arbitrary shotblast processing condition enables a computer to simulate drawing the dent rate and the dent distribution diagram. Therefore, the method 3 provides an excellent practical effect in that the shotblast processing condition setting can easily be made for obtaining a desired dent distribution status for any one of a variety of products.

In the following examples, this invention enables the shotblast processing condition to be easily set to obtain a desired dent distribution status according to a variety of products from a target dent rate by giving an arbitrary shotblast processing condition. That is, this invention is a method of setting the processing condition in a shotblasting process, characterized in that a processing time is computed so that a target dent rate is attained from the number of dents per given time in a given dent unit area.

EXAMPLE 3

Figure 9:
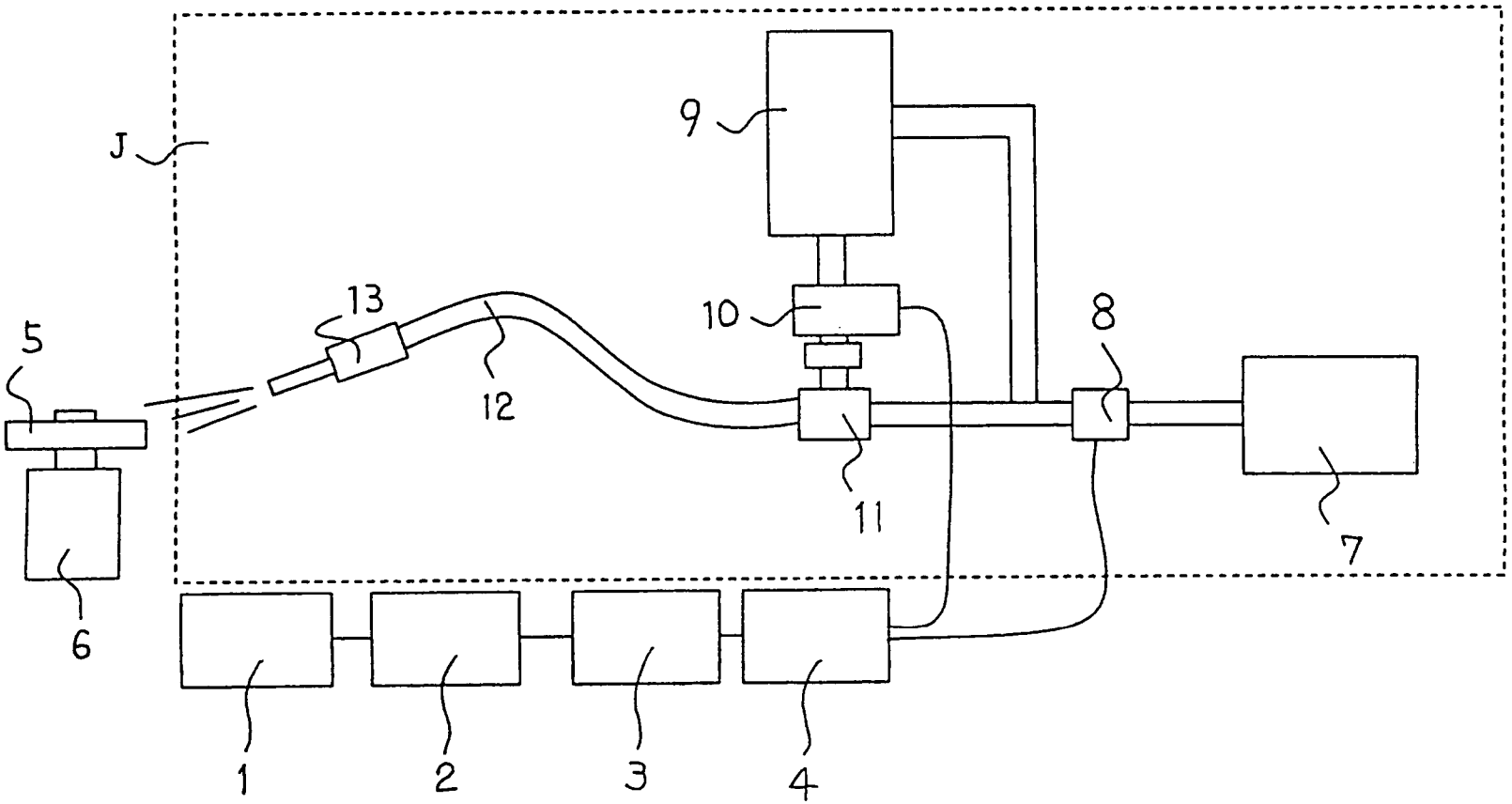
FIG. 9 is a schematic view of a shotblasting device for performing the present invention.
Figure 10:
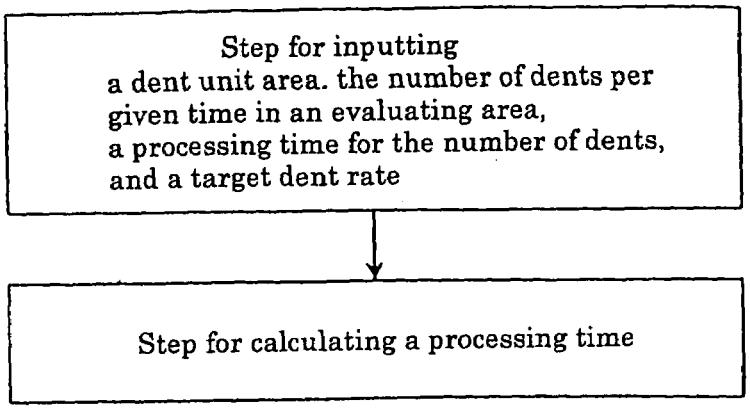
FIG. 10 is the first example of the flowchart for performing the present invention.
Figure 11:
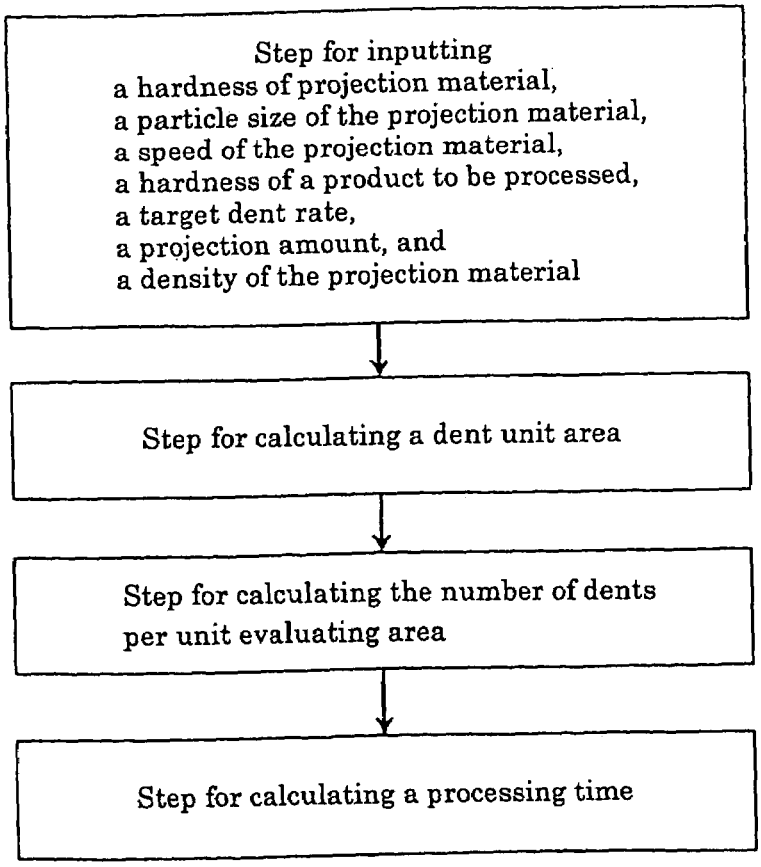
FIG. 11 is the second example of the flowchart for performing the present invention.
Figure 12:
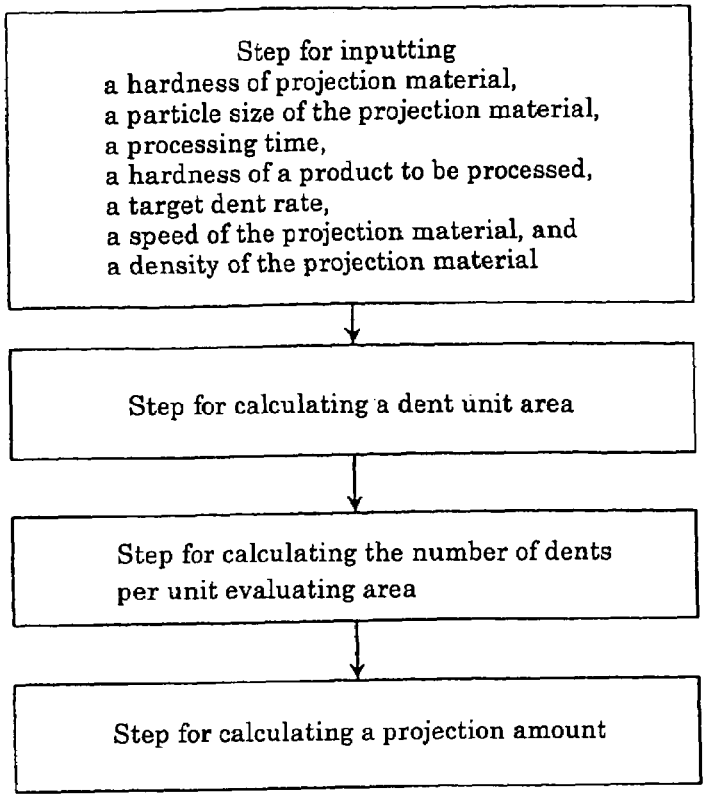
FIG. 12 is third example of the flowchart for performing the present invention.
Figure 13:
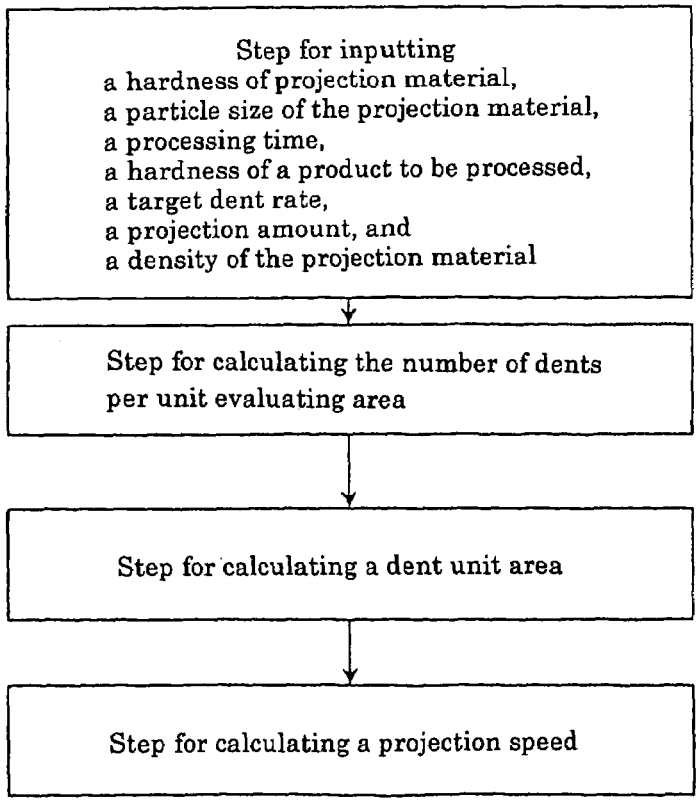
FIG. 13 is the fourth example of the flowchart for performing the present invention.

FIG. 9 is a diagram to explain a shotblasting process used for this invention. A shotblasting device in FIG. 9 has input means 1 for inputting a target dent rate and a shotblast processing condition; memory means 2 for storing the shotblast processing condition; calculating means 3 for calculating a processing time for attaining the target dent rate for a surface of a product, based on the data called from the memory means; control means 4 for controlling the shotblasting device to operate for just a period of the processing time calculated by calculating means 3. The device further includes holding means 6 for holding a product 5 and projection material accelerator means J for accelerating a projection material toward the product 5 under the shotblast processing condition.

The projection material accelerator means J is provided with a compressed air supply valve 8 connected with a compressed air supply portion 7. The compressed air supply valve 8 is connected with a mixing portion 11 directly and indirectly, i.e., through a pressurizing tank 9 and a projection material supply valve 10.

The compressed air supply valve 8 and the projection material supply valve 10 are electrically connected with control means 4. Further, the mixing portion 11 is connected with a transfer hose 12 and a nozzle 13, so that the projection material is projected from the nozzle toward the product 5. The projection material accelerator means N may be a mainstream type that uses air or another type that does not use air.

The method for obtaining the processing time in this shotblasting device is explained. First, in an inputting step a dent unit area, the number of dents per given period of time in a unit evaluation area, a processing time for the number of dents, and a target dent rate are inputted from the inputting means 1 to the memory means 2.

Then, the computer, by the calculating means 3, calculates a processing time for attaining the target dent rate for the surface of the product based on the data called from the memory means 2. From a dent unit area A, the number of dents per unit time and area N pieces·$mm^2$·sec, and an evaluation area As $mm^2$, a dent unit area A: 0.24 $mm^2$, the number of dents N: 100 piece·$mm^2$·sec, a processing time 5 sec for it, an evaluation area As: 100 $mm^2$, and a target dent rate C: 70% were inputted to the computer; the number of dents necessary for the target dent rate was calculated as 500 from the theoretical formula $C=100\{1-\exp(-A\cdot N/As)\}$; and the processing time for the target dent rate was calculated as 5 sec×(500/100)=25 sec.

Further, the control means 4 controls the shotblasting device to operate for just a period of the processing time calculated by the calculating means 3.

Thus, by just inputting the dent unit area, the number of dents per given time in the unit evaluation area, the processing time for the number of dents, and the target dent rate, the processing time is easily determined, and the shotblasting process is performed for just the period of that determined processing time.

EXAMPLE 4

In this example the same shotblasting device as in example 3 was used. In this shotblasting device the projection material particle size, the density of the projection material, the hardness of the projection material, the projection amount, the speed of the projection material, the hardness of the product to be processed, and the target number of dents were inputted as the shotblast processing condition.

Then, the computer calculates the dent unit area from the empirical formulas $A=\pi D^2/4$ and $D=k\mathbf{1}\cdot d\cdot\{1-\exp(k\mathbf{2}\cdot HVa/HVw)\}/\{1-\exp(k\mathbf{3}\cdot V)\}$ (in the dent unit area calculation step) and calculates the number of dents per unit evaluation area from the theoretical expression $C=100\{1-\exp(-A\cdot N/As)\}$, based on the dent unit area and target dent rate, both calculated in the former step, and on the evaluation area arbitrarily set.

Next, the processing time is calculated from the empirical formula $N=k\mathbf{4}\cdot M/(\rho\cdot d^3/6\cdot\pi)\cdot(t/60)$ As, based on the number of dents per unit evaluation area computed in the former step.

Similar to example 1, the computer calculates, by the calculating means 3, the processing time for attaining the target dent rate for the surface of the product based on the data called from the memory means 2. The control means 4 then controls the shotblasting device to operate for just a period of the processing time calculated by the calculating means 3.

Thus, by just inputting the projection material particle size, the density of the projection material, the hardness of the projection material, the amount of projection, the speed of the projection material, the hardness of the product to be processed, and the target number of dents as the shotblast processing condition, the processing time is easily determined, and the shotblasting process is performed for just a period of the processing time.

EXAMPLE 5

In this example the same shotblasting device as in example 3 was used.

In this shotblasting device the projection material particle size, the density of the projection material, the hardness of the projection material, and the processing time, the speed of the projection material, the hardness of the product to be processed, and the target number of dents were inputted as the shotblast processing condition.

Then, the computer calculates the dent unit area from the empirical formulas $A=\pi D^2/4$ and $D=k\mathbf{1}\cdot d\cdot\{1-\exp(k\mathbf{2}\cdot HVa/HVw)\}/\{1-\exp(k\mathbf{3}\cdot V)\}$ (in the dent unit area calculating step) and calculates the number of dents per unit evaluating area from the theoretical expression $C=100\{1-\exp(-A\cdot N/As)\}$, based on the dent unit area and target dent rate, both calculated in the former step, and on the evaluation area arbitrarily set. The computer then calculates the projection amount from the empirical formula $N=k\mathbf{4}\cdot M/(\rho\cdot d^3/6\cdot\pi)\cdot(t/60)\cdot As$, based on the number of dents per unit evaluation area calculated in the former step.

Similar to example 1, the computer then calculates, by calculating means 3, the projection amount for attaining the target dent rate for the surface of the product based on the data called from the memory means 2. The control means 4 controls the shotblasting device to operate for the projection amount calculated by the calculating means 3.

Thus, by inputting the projection material particle size, the density of the projection material, the hardness of the projection material, the amount of projection, the speed of the projection material, the hardness of the product to be processed, and the target number of dents as the shotblast processing condition, the projection amount is easily determined, and the shotblasting process of the projection amount is performed.

EXAMPLE 6

In this example the same shotblasting device as in example 3 was used. In this shotblasting device the hardness of the projection material, the projection material particle size, the processing time, the hardness of the product to be processed, the projection amount, the density of the projection material, and the target number of dents were inputted as the shotblast processing condition.

Then, the computer calculates the number of dents per unit evaluation area from the empirical formula $N=k\mathbf{4}\cdot M/(\rho\cdot d^3/6\cdot\pi)\cdot(t/60)\cdot As$ and calculates the dent unit area from the theoretical expression $C=100\{1-\exp(-A\cdot N/As)\}$, based on the number of dents per unit evaluation area calculated in the former step, the target number of dents, and the evaluation area arbitrarily set.

Next, the computer computes the projection speed from the empirical formulas $A=\pi D^2/4$ and $D=k\mathbf{1}\cdot d\cdot\{1-\exp(k\mathbf{2}\cdot HVa/HVw)\}/\{1-\exp(k\mathbf{3}\cdot V)\}$.

Similar to example 1, the computer then computes the projection speed for attaining the target dent rate for the surface of the product based on the data called from the memory means 2 by the calculating means 3.

The control means 4 controls the shotblasting device to perform the shotblasting process of the projection speed calculated by the calculating means 3. In this embodiment the hardness of the projection material, the projection material particle size, the processing time, the hardness of the product to be processed, the projection amount, the density of the projection material, and the target number of dents were inputted from a communication terminal, which is located remotely and on the Internet, and were calculated by calculating means located at another place. The set projection speed was returned to the communication terminal, and the shotblasting device was operated by using the data.

Thus, by inputting the projection material particle size, the density of the projection material, the hardness of the projection material, the amount of projection, the speed of the projection material, the hardness of the processing product, and the target number of dents as the shotblast processing condition, the projection speed is easily determined, and the shotblasting process of the projection speed is performed.

Moreover, the processing condition of shotblasting process was tested many times without performing any actual shotblasting process. Further, the processing condition of shotblasting processes can be visually evaluated by drawing dent patterns.

INDUSTRIAL APPLICABILITY

In this invention a shotblasting process is applicable to remove foreign material from a surface of a product made of metal, nonmetal, plastic, etc., by projecting or jetting at a high speed a grainy projection material such as steel, ceramic, etc., by an accelerator of a centrifugal type, a fluid pressure type, or the like to collide the material against the product surface. It is also applicable to a shot peening process, which enhances the fatigue strength of the surface of the product by colliding projection material against the surface, and to a process where paints or medicine is jetted by a painting device or a medicine nebulizer instead of the projection material.

The invention claimed is:

1. A method for simulating by a computer drawing a dent distribution diagram of a surface processed by a shotblasting process, comprising:

a first inputting step for inputting a dent unit area, the number of dents, and an evaluation area to the computer;

a first computing step for computing a dent rate from a theoretical formula $C=100\{1-\exp(-A\cdot N/As)\}$, based on the inputted dent unit area, said inputted number of dents, and the inputted evaluation area, where C is a dent rate (coverage) (%), A is a dent unit area ($mm^2$), N is the number of dents (piece·$mm^2$·sec), and As is an evaluation area ($mm^2$);

a first calculating step for calculating, based on the inputted dent unit area, said inputted number of dents, and the inputted evaluation area, a drawing dent unit area, the number of dents to be drawn, and a drawing evaluation area, that are necessary to draw a dent distribution status by a drawing device;

a second calculating step for performing calculations necessary to display in the drawing evaluation area a dent pattern of said number of dents to be drawn, each of said dents having the drawing dent unit area; and a step for displaying or printing by the drawing device the dent rate and the result of the calculations performed by the second calculating step.

2. A method for simulating by a computer drawing a dent distribution diagram of a surface processed by a shotblasting process, comprising:

a dent rate inputting step for inputting a dent rate to the computer;

a dent existence ratio computing step for computing a dent existence ratio K from a theoretical formula $C=100\{1-\exp(-A\cdot N/As)\}$, based on the inputted dent rate, where C is a dent rate (coverage) (%), A is a dent unit area ($mm^2$), N is the number of dents (piece·$mm^2$·sec), As is an evaluation areas ($mm^2$), and K is a dent existence ratio ($A\cdot N/As$);

a second inputting step for inputting at least two of a drawing dent unit area, the number of dents to be drawn, and a drawing evaluating area to the computer;

a third calculating step for calculating, based on the computed dent existence ratio and the inputted at least two of the drawing dent unit area, said number of dents to be drawn, and the drawing evaluation area, a drawing dent unit area, the number of dents to be drawn, and a drawing evaluation area, that are necessary to draw a dent distribution status by a drawing device;

a fourth calculating step for performing calculations necessary to display in the drawing evaluation area a dent pattern of said number of dents to be drawn, each of said dents having the drawing dent unit area; and a step for displaying or printing by the drawing device the dent rate and the results of the calculations performed by the second calculating step.

3. A method for simulating by a computer drawing a dent distribution diagram of a surface processed by a shotblasting process, comprising:

a third inputting step for inputting a shotblast processing condition to the computer;

a dent unit area computing step for computing a dent unit area from empirical formulas $A=\pi D^2/4$ and $D=k1\cdot d\cdot\{1-\exp(k2\cdot HVa/HVw)\}/\{1-\exp(k3\cdot V)\}$, based on the inputted shotblast processing condition, where k1, k2, and k3 are coefficients (having dimensions), A is a dent unit area ($mm^2$), D is the diameter (mm) of a dent, HVa is the hardness (HV) of the projection material, d is the size (mm) of the particles of the projection material, v is a projection speed (m/sec), and HVw is the hardness (HV) of a product to be processed;

a dent number computing step for computing the number of dents from an empirical formula $N=k4\cdot M/(\rho\cdot d^3/6\cdot\pi)\cdot(t/60)\cdot As$, based on the inputted shotblast processing condition, where k4 is a coefficient (having dimensions), N is the number of dents ($piece\cdot mm^2\cdot sec$), M is a projected amount (kg/min) of the projection material, t is a processing time (sec), F is the density ($g/cm^3$) of the projection material, As is an evaluation area ($mm^2$);

a second dent rate computing step for computing a dent rate from a theoretical formula $C=100\{1-\exp(-A\cdot N/As)\}$, based on the computed dent unit area, said number of dents, and an evaluation area arbitrarily set, where C is a dent rate (%) (coverage), A is a dent unit area ($mm^2$), N is the number of dents ($piece\cdot mm^2\cdot sec$), As is an evaluation area ($mm^2$);

a fifth calculating step for calculating a drawing dent unit area, the number of dents to be drawn, a drawing evaluating area, that are necessary to display a dent distribution status by a drawing device, based on the computed dent unit area and said computed number of dents, and an evaluation area arbitrarily set;

a sixth calculating step for performing calculations necessary to display in the drawing evaluation area a dent pattern of said number of dents to be drawn, each of said dents having the drawing dent unit area; and a step for displaying or printing by the drawing device the dent rate and the results of the calculations performed by the sixth step.

4. A system for simulating by a computer drawing a dent distribution diagram of a surface processed by a shotblasting process, comprising:

a first inputting means for inputting a dent unit area, the number of dents, and an evaluation area;

a first dent rate computing means for computing a dent rate from a theoretical formula $C=100\{1-\exp(-A\cdot N/As)\}$, based on the inputted dent unit area, said inputted number of dents, and the inputted evaluation area;

a first calculating means for calculating a drawing dent unit area, the number of dents to be drawn, and a drawing evaluation area, that are necessary to display a dent distribution status by a drawing device, based on the inputted dent unit area, said inputted number of dents, and the inputted evaluation area;

a second calculating means for performing calculations necessary to display in the drawing evaluation area a dent pattern of said number of dents to be drawn, each of said dents having the drawing dent unit area; and a first drawing device for displaying or a first printing means for printing the dent rate and the results of the calculations performed by the second calculating means.

5. A system for simulating by a computer drawing a dent distribution diagram of a surface processed by a shotblasting process, comprising:

a dent rate inputting means for inputting a dent rate;

a dent existence ratio computing means for computing a dent existence ratio from a theoretical formula $C=100\{1-\exp(-A\cdot N/As)\}$, based on the inputted dent rate;

a second inputting means for inputting at least two of a drawing dent unit area, the number of dents to be drawn, and a drawing evaluation area;

a third calculating means for calculating a drawing dent unit area, the number of dents to be drawn, and a drawing evaluation area, that are necessary to display a dent distribution status by a drawing device, based on the computed dent existence ratio and said inputted at least two of the drawing dent unit area, said number of dents to be drawn, and the drawing evaluation area;

a fourth calculating means for performing calculations necessary to display in the drawing evaluation area a dent pattern of said number of dents to be drawn, each of said dents having the drawing dent unit area; and a second drawing device for displaying or a second printing means for printing the dent rate and the results of the calculations performed by the fourth calculating means.

6. A system for simulating by a computer drawing a dent distribution diagram of a surface processed by a shotblasting process, comprising:

a third inputting means for inputting a shotblast processing condition;

a dent unit area computing means for computing a dent unit area from empirical formulas $A=\pi D^2/4$ and $D=k1\cdot d\cdot\{1-\exp(k2\cdot HVa/HVw)\}/\{1-\exp(k3\cdot V)\}$, based on the inputted shotblast processing condition;

a number of dents computing means for computing the number of dents from an empirical formula $N=k4\cdot M/(\rho\cdot d^3/6\cdot\pi)\cdot(t/60)\cdot As$;

a second dent rate computing means for computing a dent rate from a theoretical equation $C=100\{1-\exp(-A\cdot N/As)\}$, based on the computed dent unit area, said computed number of dents, and an evaluation area arbitrarily set;

a fifth calculating means for calculating a drawing dent unit area, the number of dents to be drawn, and a drawing evaluation area, that are necessary to display a dent distribution status by a drawing device, based on the computed dent unit area, said computed number of dents, and the evaluation area arbitrarily set;

a sixth calculating means for performing calculations necessary to display in the drawing evaluation area a dent pattern of said number of dents, each of said dents having the dent unit area; and a third drawing device for displaying or a third printing means for printing the dent rate and the results of calculations performed by the sixth calculating means.

* * * * *